US006675757B2

(12) United States Patent
Linke et al.

(10) Patent No.: US 6,675,757 B2
(45) Date of Patent: Jan. 13, 2004

(54) INTAKE VALVE FOR AN INTERNAL COMBUSTION MACHINE

(75) Inventors: Axel Linke, Bad Nenndorf (DE); Stefan Kellermann, Barsinghausen (DE)

(73) Assignee: TRW Deutschland GmbH, Barsinghausen (DE)

( * ) Notice: Subject to any disclaimer, the term of this patent is extended or adjusted under 35 U.S.C. 154(b) by 0 days.

(21) Appl. No.: 10/059,834

(22) Filed: Jan. 30, 2002

(65) Prior Publication Data

US 2002/0100448 A1 Aug. 1, 2002

(30) Foreign Application Priority Data

Jan. 31, 2001 (WO) ..... PCT/EP01/00994

(51) Int. Cl.[7] ..... F02N 3/00
(52) U.S. Cl. ..... 123/188.2; 123/188.3
(58) Field of Search ..... 123/188.1, 188.2, 123/188.3, 188.7

(56) References Cited

U.S. PATENT DOCUMENTS

| | | | | |
|---|---|---|---|---|
| 1,727,621 A | * | 9/1929 | Taub | 123/188.1 |
| 2,100,783 A | | 11/1937 | Wladyslaw | 123/188.7 |
| 2,868,187 A | * | 1/1959 | Maurer | 123/188.1 |
| 4,362,134 A | * | 12/1982 | Worthen | 123/188.1 |

FOREIGN PATENT DOCUMENTS

| | | | |
|---|---|---|---|
| DE | 814 682 | | 7/1949 |
| DE | 33 33 326 | | 11/1984 |
| GB | 2270541 A | * | 3/1994 |
| JP | 01237310 A | * | 9/1989 |

* cited by examiner

*Primary Examiner*—Noah P. Kamen
(74) *Attorney, Agent, or Firm*—Collard & Roe, P.C.

(57) ABSTRACT

A valve having a sleeve-like screening element for protecting an internal combustion engine against deposits in a region extending up from a hollow throat to a stripping edge. The screening element has a separate contactor guide surface for the combustion air supplied to the combustion chamber whose surface temperature is lower than the critical temperature for deposits at which fuel particles coke.

8 Claims, 4 Drawing Sheets

INTAKE VALVE FOR AN INTERNAL COMBUSTION MACHINE

BACKCKGROUND OF THE INVENTION

Field of the Invention

The invention relates to an intake valve for an internal combustion engine with direct fuel injection.

SUMMARY OF THE INVENTION

Intake and outlet valves are precision engine components for blocking cross sections of flow used for controlling the gas exchange in internal combustion engines. Such valves are expected to seal the working chamber of the cylinder from the outside. Intake valves are thermally stressed to a lower degree than outlet valves because they are cooled by the flow of fresh gas streaming around these valves. It is therefore easier to control the problems associated with intake valves than those attendant to outlet valves. However, as part of the tendency to save energy, design engineers of internal combustion engines are constantly faced with the challenge of meeting higher fuel saving requirements. These engineers are expected to come up with more favorable fuel consumption values.

Injecting the fuel directly into the combustion chamber offers more favorable fuel consumption values as associated with Otto engines versus an external formation of the mixture, which is the most widely used method at the present time. However, direct fuel injection for Otto engines is not entirely free of problems. Although intake valves are cooled by the combustion air flowing in, deposits show after relatively short motor running time periods in the region of the valve shaft, which is freely standing in the intake channel. These deposits continue to grow during use to such an extent that any further operation of the engine is no longer possible without cleaning the valve in the region of the hollow throat and/or the constriction.

Therefore, this invention protects the zone of the hollow throat against deposits up to the stripping edge in the region of the transition from the valve shaft to the valve disk. The often-observed mechanism of the formation of deposits in these zones has to be suppressed or at least substantially reduced. This zone of the valve is known to be heated by heat conduction, starting from the surface of the disk facing the combustion chamber, and commonly reaches temperatures leading to deposits of oil residues or combustion residues. Oil residues are caused by the passage of oil on the valve control. Combustion residues may deposit in the area of the hollow throat by a return of exhaust gas. In a vehicle with direct fuel injection, the deposits require cleaning of the valve after a running time of the engine corresponding with a driven distance of about 60,000 km. The valves have to be removed from the engine for cleaning.

It has been found that a critical temperature is responsible for the formation of deposits, which are primarily caused by the carbonization (or coking) of oil residues. This critical temperature range reaches from about 80° C. to 380° C. Coatings of deposits do not adhere below this range. Above 380° C., the depositing oil carbon is burned (incinerated) and scales off. It is known, furthermore, that if the mixture is formed outside of the combustion chamber, there are distinctly fewer problems with deposits.

Therefore, a valve naturally has to have a temperature that is lower than 180° C. or higher than 380° C. Reducing the temperature could be accomplished with materials exhibiting superior thermal conductivity, or by interrupting the conduction of heat in the valve, for example by means of an unfilled cavity.

A valve seat ring with poor thermal conductivity or a filled hollow valve assuring superior heat transport from the disk in the direction of the shaft could lead to a temperature higher than 380° C. However, these technical solutions, which are entirely realizable, result in much higher costs.

A valve for internal combustion engines, in particular for engines with fuel injection, which has a protective jacket, is already known from DE-OS 33 33 326. The protective jacket as opposed to the valve is designed as a structural element that is capable of oscillating, so that deposits of the fuel admixed to the combustion air are avoided by knocking them off. Experience shows that this solution has not been successful with vehicle engines with direct injection of gasoline. The valves have to be cleaned after a driven distance of about 60,000 km.

Furthermore, the use of a screening element is known from DE-PS 814 682. In particular, with outlet valves, this screening element is expected to protect the backside of the valve against excessive introduction of heat by the combustion gases flowing by. The problems known regarding outlet valves caused by high temperatures, however, do not arise with intake valves because a flow of cool fresh gases is cooling these intake valves.

One object of the invention is to provide an intake valve made from a material used for an internal combustion machine with direct fuel injection whose surface comes into contact with the combustion air flowing in. This intake valve is protected against deposits in the region between the hollow throat and the stripping edge on the valve shaft by simple means at favorable cost. This problem is solved by the screening element in providing a transition zone extending from the zone of the hollow throat of the valve disk up to the stripping edge of the valve shaft. This screening element has a separate contact or guide surface for the combustion air fed into the combustion chamber and has a surface temperature lower than the carbonization (or coking) temperature of the motor oil.

A suitable screening element could be a thin-walled sleeve enclosing the construction of the wall while maintaining a defined intermediate space.

The sleeve is preferably retained in its seat by friction grip. In another advantageous development of the invention, the end of the sleeve facing the valve shaft has cuts or slits pointing in the longitudinal direction for forming elastically bending lamellas.

In another advantageous development of the invention, the sleeve is manufactured from a stainless steel that can be deep-drawn, so that it can be formed in a simple manner as a conical shape. A tubular material can be advantageously used if the sleeve needs to have a cylindrical form.

Furthermore, it is possible to coat the surface of the screening element with a material which reduces adhesion.

To obtain, a flat abutment on the valve when a cylindrical sleeve is used, the ends of the lamellas can be deformed so that a defined intermediate space is maintained between the sleeve and the surface of the valve at the same time.

Engine tests with the intake valves of the invention have also shown the formation of deposits in the region of the hollow throat but after a longer time of operation of the engine as well. Because the sleeve is mounted as a screening element, a separation is achieved between the hot surface of the valve and the atmosphere surrounding the valve. The temperature of the surface of the sleeve is decisively below the temperature of the surface of the valve, so that the surface of the sleeve exposed to the combustion air flowing in around it showed either no deposits or substantially reduced rates of residue deposits.

BRIEF DESCRIPTION OF THE DRAWINGS

Other objects and features of the present invention will become apparent from the following detailed description considered in connection with the accompanying drawings which disclose at least one embodiment of the present invention. It should be understood, however, that the drawings are designed for the purpose of illustration only and not as a definition of the limits of the invention.

In the drawings, wherein similar reference characters denote similar elements throughout the several views.

DETAILED DESCRIPTION OF THE PREFERRED EMBODIMENT

Figure 1:
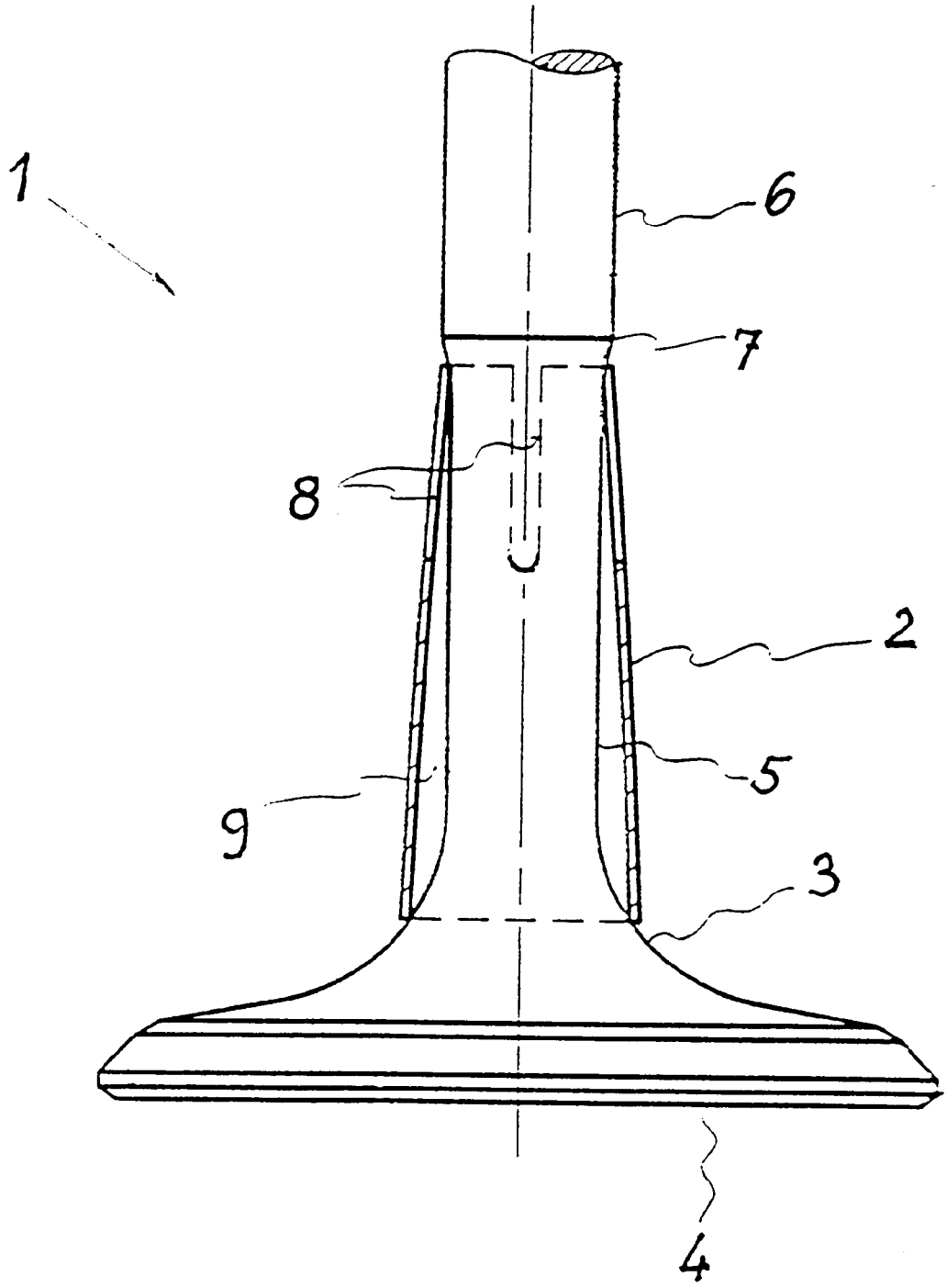
FIG. 1 shows an intake valve with a conical sleeve.

Referring to the drawings, FIG. 1 shows an intake valve 1 which is fitted with a conical sleeve 2. Sleeve 2 extends from hollow throat region 3, which forms a transition reaching from valve disk 4, to a constriction 5 of valve shaft 6. This sleeve extends up to stripping edge 7 from valve shaft constriction 5 on the side of valve shaft 6. When valve 1 is closed, stripping edge 7 immerses by about half of the height of the stroke in a guide (not shown), and when valve 1 is opened, it protrudes from the guide by about half of the stroke. Stripping edge 7 of valve 1 and the sharp edge of a valve guide bore keep each other clean in this way.

The end of the sleeve resting against the constriction of valve shaft 6 has slits or cuts 8, which forms lamellas that rest against constriction 5 in a springy manner and retain the sleeve by friction grip. With its end facing valve disk 4, the sleeve supports itself on hollow throat 3. Space 9 between the sleeve and the valve has a defined size.

Figure 2:
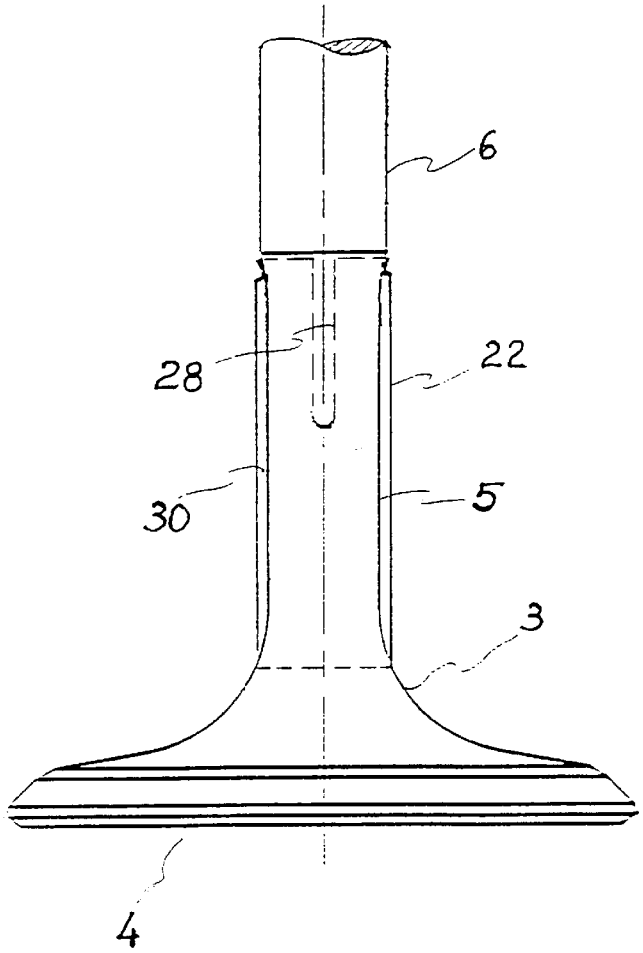
FIG. 2 shows an intake valve with a cylindrical sleeve.
Figure 3:
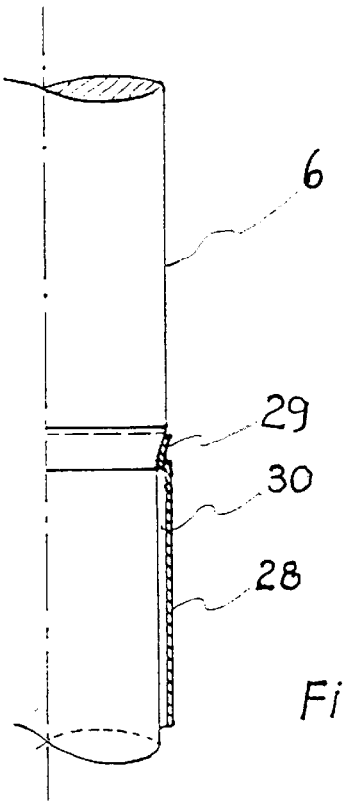
FIG. 3 shows the end of the sleeve according to FIG. 2 resting against the intake valve in a clamping manner, the end being shown as an enlarged detail.

FIGS. 2 and 3 show an intake valve with a cylindrical sleeve 22. Sleeve 22 embraces valve constriction 5 with a defined spacing 30 as well. The end of the sleeve facing the valve shaft has longitudinal slits 28 to assure an elastic abutment. The free ends 29 of the lamellas formed by slits 28 are beaded in the form of an "s" to obtain both a flat abutment on the valve and an adequately large intermediate space 30. The end of the cylindrical sleeve located opposite the lamellas is supported in hollow throat 3 of the valve. This spacing 9 in FIG. 1 and 30 in FIGS. 2 and 3 keeps the heat off of valve 1 which thereby may reduce the heat to below the deposition state to keep the deposits at a minimum.

Figure 4:
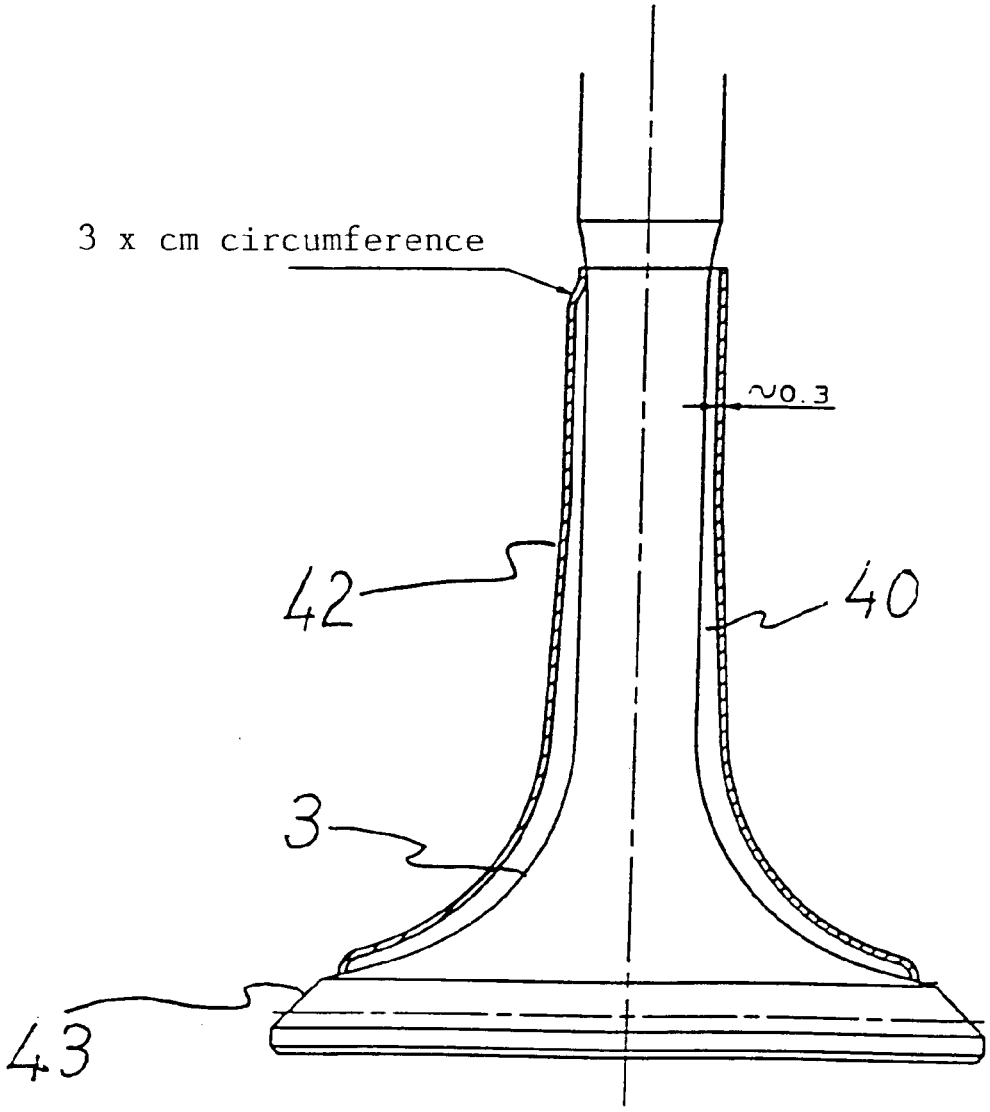
FIG. 4 shows a completely covered valve.

FIG. 4 shows a third embodiment of the invention wherein there is shown a sleeve 42 which has a frusto-conical shaped section that extends around throat region 3. Thus, this type of sleeve 42, is bell-shaped. Sleeve 42 also forms a space 40 between intake valve 1 and sleeve 42. With this design, throat region 43 is also covered by sleeve 42 so as to reduce operating temperature to further reduce deposits.

Figure 5:
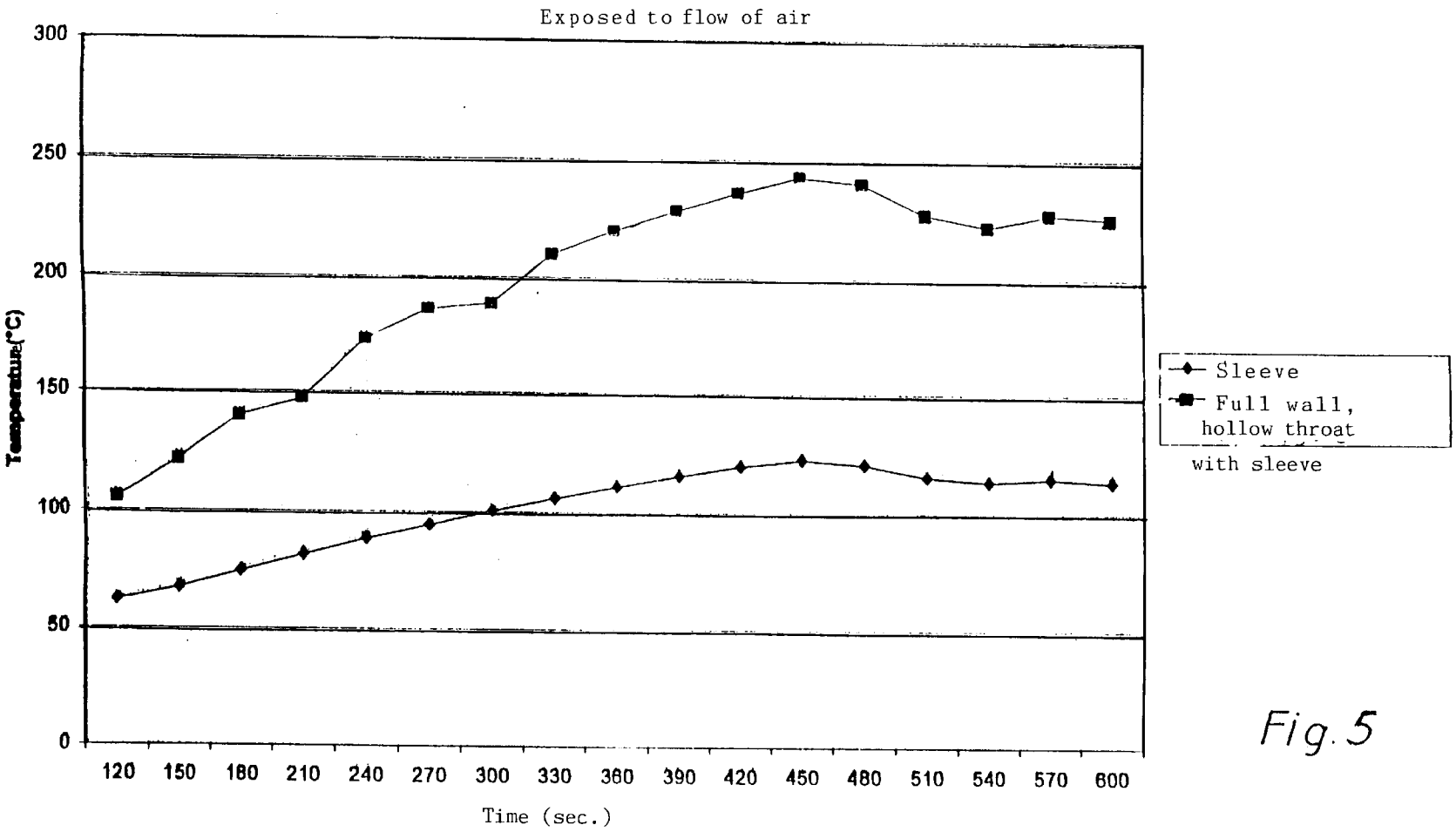
FIG. 5 shows the surface temperatures of an intake valve fitted with a sleeve dependent on time up to about 10 minutes from the start of the test run of the engine.

FIG. 5 shows a graph which indicates the temperature of valve shaft 1 vs. the time that shaft 1 is exposed to air. In this case, the temperature of the design according to the invention is shown as the bottom line of the graph while the top line shows a design according to the prior art. This design, according to the invention, shows the improvement in the reduction in heat as applied to the valve shaft.

Accordingly, while three embodiments of the present invention has been shown and described, it is obvious that many changes and modifications may be made thereunto without departing from the spirit and scope of the invention.

What is claimed is:

1. An intake valve for an internal combustion engine with direct fuel injection, the valve comprising a) a valve shaft;

b) a hollow throat that is adjacent to said valve shaft;

c) a stripping edge disposed on said valve shaft;

d) a screening element coupled to said stripping edge at one end and extending up to but not covering said hollow throat at an opposite end, wherein said screening element has a separate contact or guide surface for combustion air supplied to a combustion chamber, said screening element being in the form of a sleeve having a shape selected from the group consisting of conical, and cylindrical shapes, and having a plurality of cuts or slits pointing in a longitudinal direction for forming elastically bending lamellas.

2. The intake valve according to claim 1, wherein said valve shaft has a lip and a valve constriction extending from said valve shaft lip to said hollow throat, wherein the valve further comprises a defined intermediate space disposed between said valve constriction and said screening element.

3. The intake valve as in claim 1, wherein said sleeve is coupled to said valve shaft via a friction grip.

4. The intake valve as in claim 1, wherein said sleeve is made from deep-drawable stainless steel.

5. The intake valve according to claim 1, wherein said sleeve is coated with a material that reduces adhesion.

6. The intake valve as in claim 1, wherein the ends of the lamellas are beaded to form an intermediate space and flat abutment of the valve.

7. An intake valve in combination with an intake of an internal combustion engine with direct fuel injection, the valve comprising:

a) a valve shaft having a valve constriction section;

b) a hollow throat that is adjacent to said valve shaft;

c) a stripping edge disposed on said valve shaft; and d) a screening element coupled to said stripping edge and surrounding said valve shaft in a region of said valve constriction section to form a space separating said screening element from said valve constriction section, wherein said screening element has a separate contact or guide surface for combustion air supplied to a combustion chamber, said screening element being in the form of a sleeve having a shape selected from the group consisting of conical, cylindrical and bell-shaped, and having a plurality of cuts or slits pointing in a longitudinal direction for forming elastically bending lamellas.

8. An intake valve for an internal combustion engine with direct fuel injection, the valve comprising a) a valve shaft;

b) a hollow throat that is adjacent to said valve shaft;

c) a stripping edge disposed on said valve shaft; and d) a screening element coupled to said stripping edge wherein said screening element has a separate contact or guide surface for combustion air supplied to a combustion chamber, said screening element being in the form of a sleeve having a shape selected from the group consisting of conical, cylindrical and bell-shaped, and having a plurality of cuts or slits pointing in a longitudinal direction for forming elastically bending lamellas having free ends that are beaded in a form of a "s" shape.

* * * * *